US007723604B2

(12) United States Patent
Bang et al.

(10) Patent No.: US 7,723,604 B2
(45) Date of Patent: May 25, 2010

(54) APPARATUS AND METHOD FOR GENERATING MUSICAL TONE ACCORDING TO MOTION

(75) Inventors: Won-chul Bang, Yongin-si (KR); Jun-il Sohn, Yongin-si (KR); Ji-hyun Choi, Yongin-si (KR); Eun-seok Choi, Yongin-si (KR); Dong-yoon Kim, Yongin-si (KR); Yeun-bae Kim, Yongin-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 46 days.

(21) Appl. No.: 11/704,303

(22) Filed: Feb. 9, 2007

(65) Prior Publication Data

US 2007/0186759 A1 Aug. 16, 2007

(30) Foreign Application Priority Data

Feb. 14, 2006 (KR) ..... 10-2006-0014272

(51) Int. Cl.
*G10H 7/00* (2006.01)

(52) U.S. Cl. ..... 84/615; 84/626; 84/653; 84/662

(58) Field of Classification Search ..... 84/615, 84/626, 653, 662
See application file for complete search history.

(56) References Cited

U.S. PATENT DOCUMENTS

| | | | | | |
|---|---|---|---|---|---|
| 4,341,140 | A * | 7/1982 | Ishida | 84/711 |
| 4,968,877 | A * | 11/1990 | McAvinney et al. | 250/221 |
| 5,017,770 | A * | 5/1991 | Sigalov | 250/221 |
| 5,081,896 | A * | 1/1992 | Hiyoshi et al. | 84/600 |
| 5,369,270 | A * | 11/1994 | Gurner et al. | 250/221 |
| 5,414,256 | A * | 5/1995 | Gurner et al. | 250/221 |
| 5,442,168 | A * | 8/1995 | Gurner et al. | 463/36 |
| 5,459,312 | A * | 10/1995 | Gurner et al. | 250/221 |
| 5,475,214 | A * | 12/1995 | DeFranco et al. | 250/221 |
| 5,808,219 | A * | 9/1998 | Usa | 84/600 |
| 5,875,257 | A * | 2/1999 | Marrin et al. | 382/107 |
| 6,222,465 | B1 * | 4/2001 | Kumar et al. | 341/20 |
| 6,492,775 | B2 * | 12/2002 | Klotz et al. | 315/120 |
| 6,685,480 | B2 * | 2/2004 | Nishimoto et al. | 434/247 |
| 6,794,568 | B1 * | 9/2004 | Callaway | 84/724 |
| 6,897,779 | B2 * | 5/2005 | Nishitani et al. | 340/573.1 |
| 6,919,503 | B2 * | 7/2005 | Nishitani et al. | 84/633 |
| 6,960,715 | B2 * | 11/2005 | Riopelle | 84/725 |
| 7,060,885 | B2 * | 6/2006 | Ishida et al. | 84/626 |
| 2001/0035087 | A1 * | 11/2001 | Subotnick | 84/600 |
| 2003/0159567 | A1 * | 8/2003 | Subotnick | 84/626 |

FOREIGN PATENT DOCUMENTS

| | | |
|---|---|---|
| JP | 2003-76368 | 3/2003 |
| JP | 2003-116177 | 4/2003 |
| JP | 2004-252149 | 9/2004 |
| KR | 10-0451183 | 9/2004 |
| KR | 10-2005-0034940 | 4/2005 |

* cited by examiner

*Primary Examiner*—David S. Warren

(57) ABSTRACT

An apparatus and method to output a musical tone is disclosed. More particularly, disclosed is an apparatus and method to output a musical tone according to motion, which divides a space in which a terminal can move into a plurality of subspaces, and matches the subspaces with different musical tones, so that the terminal can output a musical tone matched with a specific subspace when the terminal has moved into the specific subspace.

27 Claims, 7 Drawing Sheets

FIG. 3

310 320 330 340 350 300

| ID NO. | LOCATION | SHAPE | SIZE | PITCH |
|---|---|---|---|---|
| 1 | (x1, y1, z1) | QUADRANGLE | 10 | DO |
| 2 | (x2, y2, z2) | QUADRANGLE | 10 | RE |
| 3 | (x3, y3, z3) | QUADRANGLE | 10 | MI |
| 4 | (x4, y4, z4) | QUADRANGLE | 10 | FA |
| 5 | (x5, y5, z5) | TRIANGLE | 12 | SO |
| 6 | (x6, y6, z6) | TRIANGLE | 12 | LA |
| 7 | (x7, y7, z7) | TRIANGLE | 12 | TI |

FIG. 4

410 420 400

| ID NO. | PATTERN | | |
|---|---|---|---|
| | 1st PATTERN(421) | 2nd PATTERN(422) | 3rd PATTERN(423) |
| 1 | PIANO | VIOLIN | SNARE DRUM |
| 2 | PIANO | VIOLIN | TOM-TOM 1 |
| 3 | PIANO | VIOLIN | TOM-TOM 2 |
| 4 | PIANO | VIOLIN | TOM-TOM 3 |
| 5 | PIANO | VIOLIN | BASE DRUM |
| 6 | PIANO | VIOLIN | HI-HAT |
| 7 | PIANO | VIOLIN | CYMBALS |

APPARATUS AND METHOD FOR GENERATING MUSICAL TONE ACCORDING TO MOTION

CROSS-REFERENCE TO RELATED APPLICATION

This application claims priority from Korean Patent Application No. 10-2006-0014272 filed on Feb. 14, 2006 in the Korean Intellectual Property Office, the disclosure of which is incorporated herein by reference in its entirety.

BACKGROUND OF THE INVENTION

1. Field of the Invention

The present invention relates to an apparatus and method to output a musical tone, and more particularly to an apparatus and method to output a musical tone according to motion, which divides a space in which a terminal can move into a plurality of subspaces, and matches the subspaces with different musical tones, so that the terminal can output a musical tone matched with a specific subspace when the terminal has moved into the specific subspace.

2. Description of the Related Art

An inertial sensor senses the inertial force of a mass, which is caused by acceleration or angular motion, through deformation of an elastic member connected to the mass, and then outputs an electrical signal corresponding to the deformation of the elastic member by using an appropriate signal processing technology.

With the development of micro-electromechanical systems, it has become possible to miniaturize and mass produce inertial sensors. Inertial sensors are largely classified into acceleration sensors and angular sensors; they have become important in various fields, such as integrated control of vehicle suspension and brake systems, air bag systems, and car navigation systems. Also, the inertial sensor has been utilized as a data input means for portable devices, such as portable position-recognition systems (e.g., portable digital assistants) applied to a mobile intelligent terminal.

Also, in the aerospace field, the inertial sensor has been applied not only to the navigation systems of general airplanes but also to macro-air-vehicles, missile-attitude control systems, personal navigation systems for the military, and others. In addition, the inertial sensor has recently been applied to continuous motion recognition and three-dimensional games in a mobile terminal.

Also, a mobile terminal able to play a percussion instrument according to the motion of the terminal has been developed. Such a mobile terminal recognizes corresponding motions by means of a built-in inertial sensor, and outputs pre-stored percussion instrument tones according to the recognized motions. In this case, the percussion instrument may be selected and determined by the user. In order to play a percussion instrument according to motion, an acceleration sensor has been used to detect motion of a user because it is inexpensive and the size of a component that can be mounted in the mobile terminal is limited.

Japanese Patent Laid-Open No. 2003-76368 discloses a method for detecting a terminal's motion performed by the user and generating a sound in a mobile terminal, which includes a motion-detecting sensor such as a three-dimensional acceleration sensor. That is, according to the disclosed method, the mobile terminal determines a user's motions based on up, down, right, left, front, and rear accelerations, and generates a sound.

However, since the disclosed method is restricted to generating only a sound according to motion, it is difficult for the user to express various sound sources. Therefore, a method for simply and easily generating tones of various (built-in) sound sources is required.

SUMMARY OF THE INVENTION

Additional aspects and/or advantages of the invention will be set forth in part in the description which follows and, in part, will be apparent from the description, or may be learned by practice of the invention.

Accordingly, the present invention has been made to solve the above-mentioned problems occurring in the prior art, and an aspect of the present invention is to provide an apparatus and method for outputting a musical tone(sound) corresponding to a specific subspace according to motions of a mobile terminal located in the specific subspace, by dividing a space in which a terminal can move into a plurality of subspaces and matching the subspaces with different musical tones.

Another aspect of the present invention is to provide an apparatus and method for outputting different musical tones depending on motion within each subspace.

In order to accomplish these aspects, there is provided an apparatus for generating a tone according to a motion, the apparatus including: a motion-input unit to which a first motion for movement and a second motion having a predetermined pattern are input; a location-identifying unit to identify a location of a subspace determined by the first motion in a space divided into at least one subspace; a tone-extracting unit to extract a tone corresponding to the subspace at the identified location when the second motion has been input; and an output unit for outputting the extracted tone.

In another aspect of the present invention, there is provided a method of generating a tone according to a motion, the method including: receiving a first motion for movement and a second motion having a predetermined pattern; identifying a location of a subspace determined by the first motion in a space divided into at least one subspace; extracting a tone corresponding to the subspace at the identified location when the second motion has been input; and outputting the extracted tone.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 3 is a view illustrating the construction of a subspace table according to an embodiment of the present invention;

FIG. 4 is a view illustrating the construction of a pattern table according to an embodiment of the present invention;

DETAILED DESCRIPTION OF THE PREFERRED EMBODIMENTS

Figure 1:
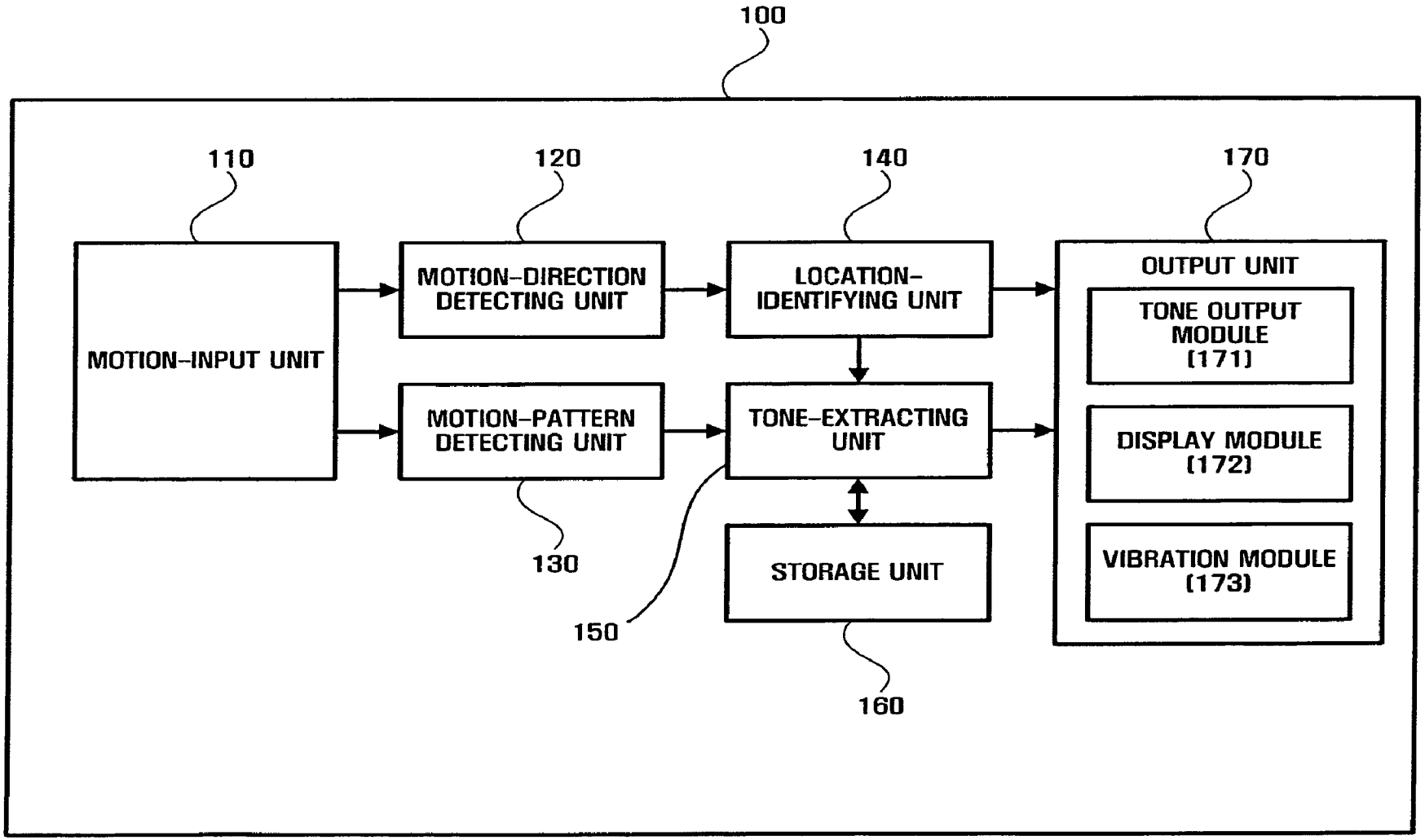
FIG. 1 is a block diagram illustrating the construction of an apparatus to output musical tones according to motion based on an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Advantages and features of the present invention, and methods to achieve them will be apparent to those skilled in the art from the detailed description of the embodiments together with the accompanying drawings. The scope of the present invention is not limited to the embodiments disclosed in the specification and the present invention can be realized in various types. The described present embodiments are presented only for completely disclosing the present invention and helping those skilled in the art to completely understand the scope of the present invention, and the present invention is defined only by the scope of the claims. In the following description of the present invention, the same drawing reference numerals are used for the same elements even in different drawings FIG. 1 is a block diagram illustrating the construction of an apparatus (hereinafter, referred to as "tone output apparatus") to output musical tones according to motion based on an embodiment of the present invention. The tone output apparatus 1000 includes a motion-input unit 110, a motion direction detecting unit 120, a motion pattern detecting unit 130, a location-identifying unit 140, a tone-extracting unit 150, a storage unit 160, and an output unit 170.

The motion-input unit 110 functions to detect motion. Herein, the input motion includes a motion (hereinafter, referred to as "first motion") for movement and a motion (hereinafter, referred to as "second motion") having a predetermined pattern. The first motion represents that the tone output apparatus 100 moves over a predetermined distance, and the second motion represents a motion performed by the tone output apparatus 100 within a predetermined region of space.

To this end, the motion-input unit 110 may separately include a first motion-input unit to detect the first motion and a second motion-input unit to detect the second motion or at least one motion-input unit may detect the first and the second motions.

The motion-input unit 110 may use at least one sensor among a gyro sensor, a geomagnetic sensor, and an acceleration sensor in order to detect the first and/or second motions, in which each sensor generates a motion signal corresponding to a motion when having detected the motion.

The motion direction detecting unit 120 detects a movement direction and a movement distance of the tone output apparatus 100 by analyzing a motion signal generated by the first motion. When the tone output apparatus 100 has moved parallel to the earth's surface, the motion direction detecting unit 120 can detect the movement direction and the movement distance of the tone output apparatus 100 by using a motion signal generated by the gyro sensor, geomagnetic sensor, or acceleration sensor and not limited thereto. Also, when the tone output apparatus 100 has moved perpendicular to the earth's surface, the motion direction detecting unit 120 can detect the movement direction and movement distance of the tone output apparatus 100 by using a motion signal generated by the gyro sensor or acceleration sensor, but not limited thereto.

In addition, the motion direction detecting unit 120 may include a gravity sensor to sense the direction of gravity. In this case, the motion direction detecting unit 120 can exactly detect the movement direction of the tone output apparatus 100 regardless of orientation of the tone output apparatus 100, by using the motion signals of the gravity sensor and gyro sensor. For example, when the user moves the tone output apparatus 100 to the right after orienting a specific surface of the tone output apparatus 100 toward the user, the motion direction detecting unit 120 can detect that the tone output apparatus 100 has moved to the right. In this case, although the user moves the tone output apparatus 100 to the left after orienting a different surface of the tone output apparatus 100 toward the user, the motion direction detecting unit 120 can detect that the tone output apparatus 100 has moved to the left of the user because a change in orientation of the tone output apparatus 100 is sensed by the gravity sensor and gyro sensor.

The location-identifying unit 140 identifies the location of a subspace determined from the first motion in a space which is divided into one or more subspaces. That is, a space, which corresponds to a motion radius of the tone output apparatus 100, is divided into one or more subspace, each of which has a predetermined size. Therefore, the location-identifying unit 140 identifies one subspace in which the tone output apparatus 100 is located.

Herein, the location, shape, and/or size of each subspace may be determined by the user or when manufacturing the tone output apparatus 100. For example, a plurality of subspaces having a rectangular shape are arranged to be adjacent to each other or to be spaced a predetermined distance from each other, or are arranged in a single row or in a plurality of rows. In addition, the user may determine the location, shape, and/or size of each subspace as he/she pleases.

The motion pattern detecting unit 130 detects a motion pattern of the tone output apparatus 100 by analyzing a motion signal generated by the second motion. For example, the motion pattern detecting unit 130 detects motion patterns of a movement in a complicated geometrical figure as well as a linear reciprocating movement and a rotational movement, in which the motion pattern detecting unit 130 may detect different motion patterns depending on the reciprocating directions of the linear reciprocating movement and/or depending on the rotational directions of the rotational movement.

When having received the second motion, the tone-extracting unit 150 extracts a tone corresponding to a subspace, in which the tone output apparatus 100 is located, from the storage unit 160. That is, when having received a signal representing a subspace, in which the tone output apparatus 100 is located, from the location-identifying unit 140, and having received a signal representing a motion pattern from the motion pattern detecting unit 130, the tone-extracting unit 150 extracts a tone corresponding to the subspace from the storage unit 160 which stores tones corresponding to the subspaces. The term "tones corresponding to the subspaces" include tones having different pitches, which are generated by a specific musical instrument, and effect sounds. For example, when first to seventh subspaces are arranged, the tones corresponding to the subspaces may be "Do", "Re", "Mi", "Fa", "So", "La", and "Ti" if the specific musical instrument is a melodic instrument, and the tones corresponding to the subspaces may be tones of a snare drum, a first tom-tom, a second tom-tom, a third tom-tom, a base drum, a high-hat, and cymbals, if the specific musical instrument is a rhythm instrument such as a drum set. Herein, the kinds of musical instruments may be established by the user or may be determined according to the second motion.

In other words, the tone-extracting unit 150 may extract a tone of a different musical instrument depending on each motion pattern of the second motion. For example, the tone-extracting unit 150 may extract a piano tone when the pattern of a second motion corresponds to an up/down reciprocating movement, and may extract a violin tone when the pattern of a second motion corresponds to a left/right reciprocating movement. That is, the musical instrument for the output of the tone may be changed depending on the patterns of the second motion.

Meanwhile, it is apparent that the kinds of musical instruments corresponding to the subspaces may be determined according to the setup of the user or when the apparatus is manufactured, and the pitch of a tone may be changed depending on the patterns of the second motion.

The storage unit 160 stores a tone source for tones to be output. Herein, the tone source includes at least one among data (actual-tone data) of tones obtained through performance of an actual musical instrument, data of tones modified to provide a timbre of an actual musical instrument, data of tones input by the user, and data of chord tones. It is also understood that the tone source can be transmitted through a wire or wireless network.

The actual-tone data are obtained by recording tones obtained through performance of an actual musical instrument and by converting the tone into the digital data, and may have various formats such as WAV, MP3, WMA, etc. Also, the actual-tone data can be modified by the user.

Meanwhile, stored data for tones made by an actual musical instrument may include only a reference tone instead of all tones according to composition. That is, in the case of C key, the actual-tone data may include only a tone source corresponding to "Do".

The data of tones modified to provide a timbre of an actual musical instrument include, for example, a tone of a MIDI source, and can obtain a specific tone by applying the pitch corresponding to the specific tone to the reference tone source.

The data of tones input by the user include data of tones similar to tones obtained through performance of an actual musical instrument, in which the user may input an effect sound, other than specific tone. Therefore, the tone output apparatus 100 can serve not only as a melodic instrument to output tones according to motion but also as a percussion instrument and a special musical instrument.

The data of chord tones have specific tones as a root, in which the root may be tones corresponding to the subspaces. For example, when a relevant subspace corresponds to the tone of "Do", tones of "Do", "Mi", and "So" corresponding to the C chord may be simultaneously output. Therefore, the user can play the tone output apparatus 100 so as to output chords according to motions of the tone output apparatus 100.

Also, the storage unit 160 may store a subspace table. The subspace table stores subspaces and tones corresponding to the subspaces, so that the tone-extracting unit 150 can extract tones with reference to the subspace table. The subspace table will be described later in detail with reference to FIG. 3.

Also, the storage unit 160 may store a pattern table. The pattern table stores the kinds of second motions and musical instruments corresponding to the kinds of second motions, so that the tone output apparatus 100 can extract and change musical instruments with reference to the pattern table. The pattern table will be described later in detail with reference to FIG. 4.

The storage unit 160 is a module capable of inputting/outputting information, such as a hard disk, a flash memory, a compact flash (CF) card, a secure digital (SD) card, a smart media (SM) card, a multimedia (MMC) card, memory stick, and others. The storage unit 160 may be either included in the tone output apparatus 100 or separately constructed.

The output unit 170 outputs tones extracted by the tone-extracting unit 150. Also, the output unit 170 may output an effect sound when a determined subspace has changed by a first motion. Therefore, the user can recognize that a subspace has been changed by his/her motion.

Also, the output unit 170 may display colors corresponding to the kind of subspaces determined by the motion of the user himself/herself. For example, when first to seventh subspaces are arranged, red, orange, yellow, green, blue, indigo, and violet may correspond to the seven subspaces, respectively. In this case, when the tone output apparatus 100 has been located in the first subspace, the tone output apparatus 100 displays red, and when the tone output apparatus 100 has been located in the fourth subspace, the tone output apparatus 100 displays green. Therefore, the user can recognize a subspace in which the tone output apparatus 100 is located based on the motion of the user himself/herself.

Also, the output unit 170 may generate a vibration as soon as the tone output apparatus 100 enters each subspace according to a first motion. In this case, a vibration having an identical pattern may be generated with respect to all the subspaces, or vibrations having different patterns may be generated depending on the subspaces. Also, the output unit 170 may continuously generate such a vibration while the tone output apparatus 100 stays in a relevant subspace, as well as the moment when the tone output apparatus 100 enters the relevant subspace. In addition, the output unit 170 may generate a vibration in synchronization with a motion having a predetermined pattern, which is a second motion. For example, when an up-and-down reciprocating movement, which is a second motion, corresponds to a motion of beating a drum, the output unit 170 may generate a vibration when a tone is generated, that is, at the moment when a movement direction is changed between up and down. Therefore, according to vibration patterns of the output unit 170, the user can identify first and second motions, which have been input by the user himself/herself.

In order to output the tone of a specific musical instrument and an effect sound, to display a color, and to generate a vibration, the output unit 170 may include a tone (sound) output module 171, a display module 172, and/or a vibration module 173.

The tone output module 171 outputs a tone signal. That is, the tone output module 171 converts an electrical signal including tone information into a vibration of a diaphragm so as to generate a compression-rarefaction wave in air, thereby radiating a tone wave. Generally, the tone output module 171 is constructed with a speaker.

Such a tone output module 171 can convert an electrical signal into a tone wave by using a dynamic scheme, an electromagnetic scheme, an electrostatic scheme, a dielectric scheme, a magnetostrictive scheme, and/or others.

The display module 172 includes an image display unit, such as a cathode ray tube (CRT), a liquid crystal display (LCD), a light-emitting diode (LED), an organic light-emitting diode (OLED), and/or a plasma display panel (PDP), so as to display an image of an input signal. The display module 172 displays colors corresponding to the subspaces.

The vibration module 173 generates a vibration either electronically or by using a motor but not limited thereto. The electronic vibration module, which uses the principle of an electromagnet, vibrates a core by interrupting the electric current flow through a coil by several score times or several hundred times per one second. The vibration module using a motor transfers the rotation of the motor to a counterweight axis through a coil spring, and the center of gravity is inclined to one side, thereby generating a vibration.

Figure 2:
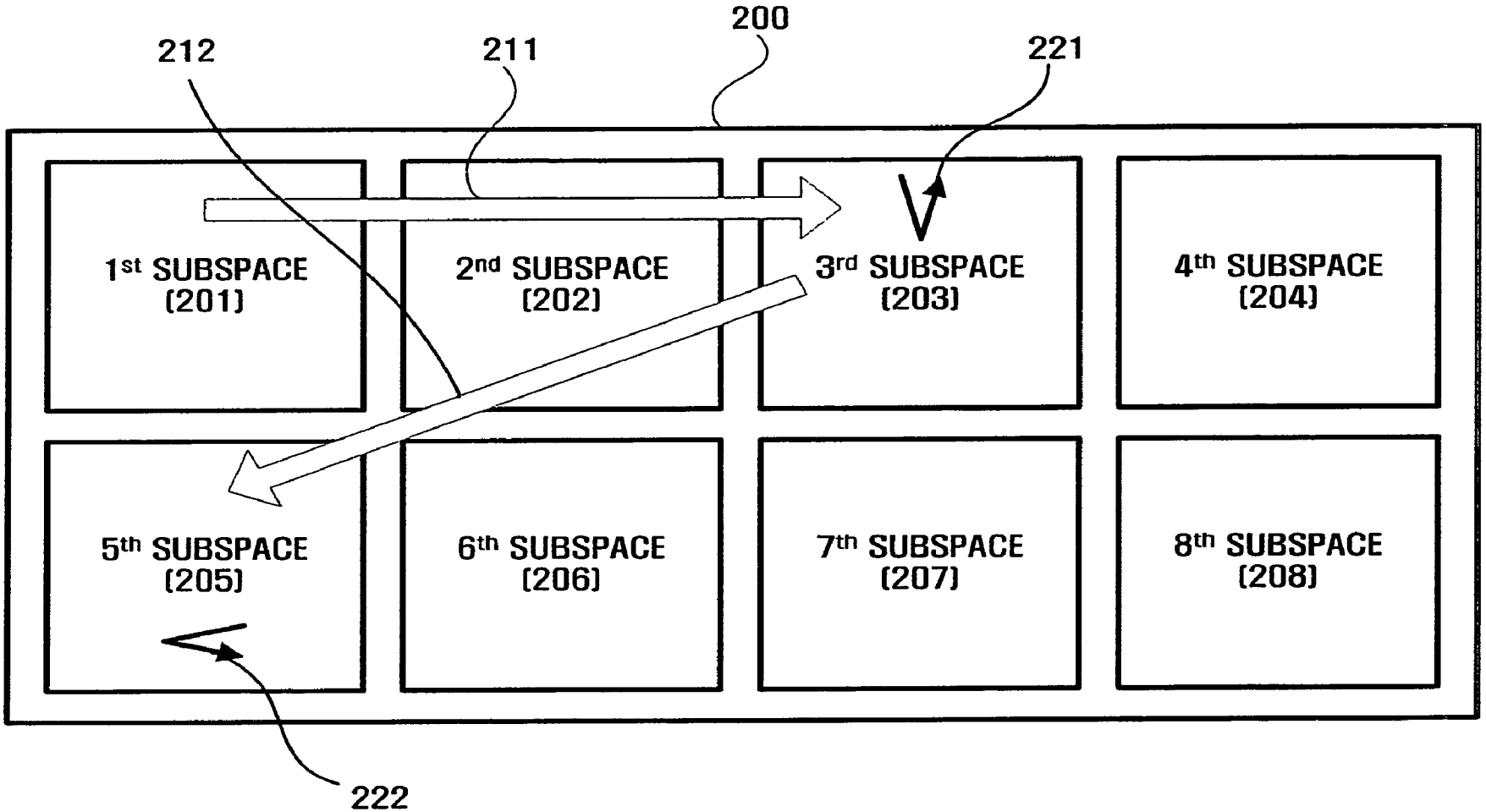
FIG. 2 is a block diagram illustrating the concept of a space divided into subspaces according to an embodiment of the present invention.

FIG. 2 is a block diagram illustrating the concept of a space divided into subspaces according to an embodiment of the present invention, in which a movement space 200 of the tone output apparatus 100 is divided into eight subspaces 201 to 208, for example. It is understood that the movement space can be divided into more than eight or less than eight subspaces.

The subspaces are spatial regions, in which the second motions 221 and 222 of the tone output apparatus 100 can be detected, and whose arrangement, shapes, and sizes may be determined by the user.

When the user performs a first motion 211 and/or 212, that is, when the user performs a motion for changing a subspace in which the tone output apparatus 100 is located, the first motion is detected by the motion direction detecting unit 120 and is transferred to the location-identifying unit 140. Then, the location-identifying unit 140 identifies the subspace in which the tone output apparatus 100 is finally located. That is, such a first motion includes a movement between subspaces by two or more steps as well as a movement between subspaces by one step.

Meanwhile, when the user performs a second motion 221 or 222,which has predetermined pattern, the second motion is detected by the motion pattern detecting unit 130 and the detected second motion is transferred to the tone-extracting unit 150. Then, the tone-extracting unit 150 extracts a musical tone from the storage unit 160 based on the corresponding subspace and the second motion 221 or 222.

For example, in the case in which the first to eight subspaces 201 to 208 shown in FIG. 2 correspond to tones of "Do", "Re", "Mi", "Fa", "So", "La", "Ti", and "Do", respectively. When the tone output apparatus 100 has moved from the first subspace 201 to the third subspace 203, the tone output apparatus 100 outputs the tone of "Mi". Next, when the tone output apparatus 100 has moved from the third subspace 203 to the fifth subspace 205, the tone output apparatus 100 outputs the tone of "So". In this case, the tone output apparatus 100 may extract and output tones of different musical instruments depending on the patterns of the second motions 221 and 222. For example, when having been the second motion 221 including an up/down movement, the tone output apparatus 100 may extract and output the tones of a piano, and when having received the second motion 222 including a left/right movement, the tone output apparatus 100 may extract and output the tones of a violin.

The subspaces may be arranged in a two dimensional space as shown in FIG. 2, or may be arranged in a three dimensional space.

FIG. 3 is a view illustrating the construction of a subspace table according to an embodiment of the present invention. A subspace table 300 includes an identification number field 310, a location field 320, a shape field 330, a size field 340, and/or a pitch field 350.

The identification number field 310 contains identification numbers assigned to each subspace, and is used by the location-identifying unit 140 when the location-identifying unit 140 notifies the tone-extracting unit 150 of the location of the tone output apparatus 100. That is, when the location-identifying unit 140 identifies the location of the tone output apparatus 100, an identification number assigned to a corresponding subspace is transferred to the tone-extracting unit 150, and then the tone-extracting unit 150 extracts a musical tone corresponding to the transferred identification number.

The location field 320 contains the location values of the subspaces, in which the location values input into the location field 320 mean relative locations based on a reference location. For example, it is possible that the user determines a reference location, and then determines the location of each subspace by using a button or the like in a space spaced by a predetermined interval from the reference location. The locations of the subspaces may be determined in a two or three-dimensional space.

The shape field 330 includes the shapes of subspaces, which are determined by the user when the subspaces are set up or determined when is manufactured.

The size field 340 includes sizes of the subspaces, which are determined by the user or at a factory when the subspaces are set up. That is, the user can determine an interval between the subspaces by setting the location and size of the subspaces.

The pitch field 350 includes pitches of tones to be extracted. The pitches of the tones may be determined by the user when the subspaces are set up or at a factory, too. Meanwhile, the pitches of the tones are used only when a melodic instrument is selected. When a rhythm instrument is selected, different effect sounds based on a pattern table of FIG. 4 may be used.

FIG. 4 is a view illustrating the construction of a pattern table according to an embodiment of the present invention. A pattern table 400 includes an identification number field 410 and a pattern field 420.

The identification number field 410 includes identification numbers assigned to each subspace, which is the same as that in the subspace table 300. The identification number field 410 has the same construction as that of the subspace table 300 described with reference FIG. 3 in advance, so a detailed description thereof will be omitted.

The pattern field 420 includes types of motion patterns of the tone output apparatus 100, which are included in the second motion. According to the types of motion patterns, different musical instruments sound or tone may be extracted. For example, a tone of a piano may be extracted when a first pattern 421 of an up/down movement has been received, a tone of a violin may be extracted when a second pattern 422 of a left/right movement has been received, and an effect sound of a drum set may be extracted when a third pattern of a circular movement has been received.

That is, the user can control the tone output apparatus 100 to extract tones of various musical instruments in subspace.

The pattern table 400 may be not stored in the storage unit 160, as selected by the user. In this case, the tone-extracting unit 150 extracts tones of a reference musical instrument, e.g. a piano, a violin, etc., with respect to all the patterns of second motions including the up/down movement, left/right movement, and/or circular movement.

Figure 5A:
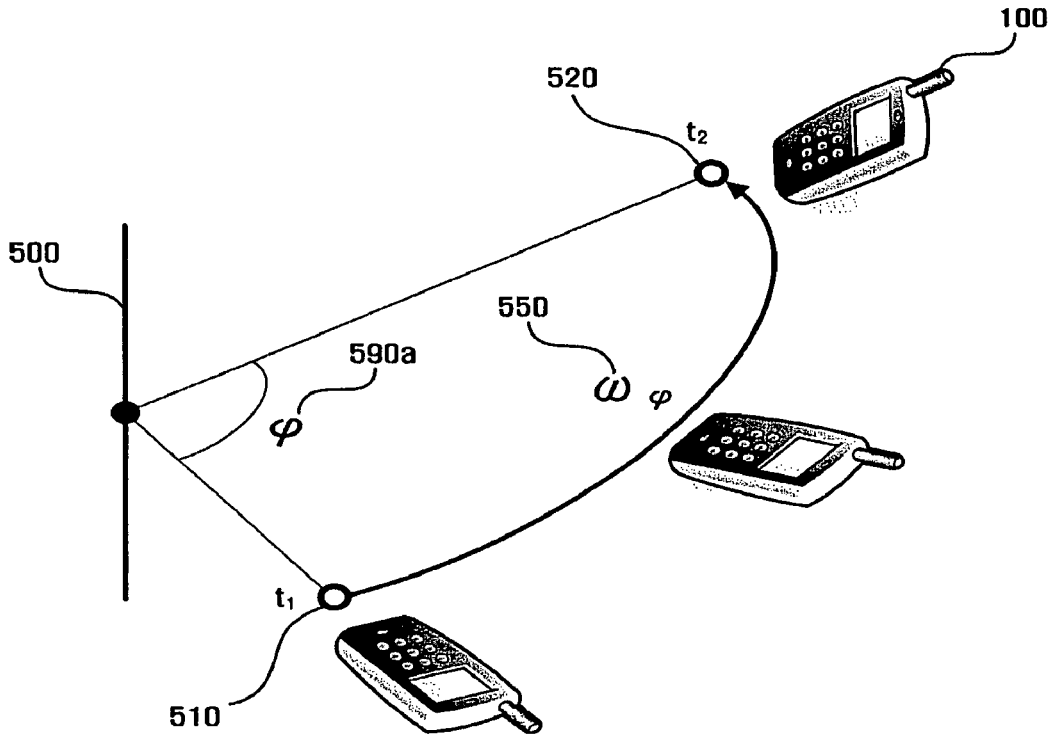
FIGS. 5A to 5C are views for explaining various methods of detecting the movement direction and movement distance of a tone output apparatus according to embodiments of the present invention.
Figure 5B:
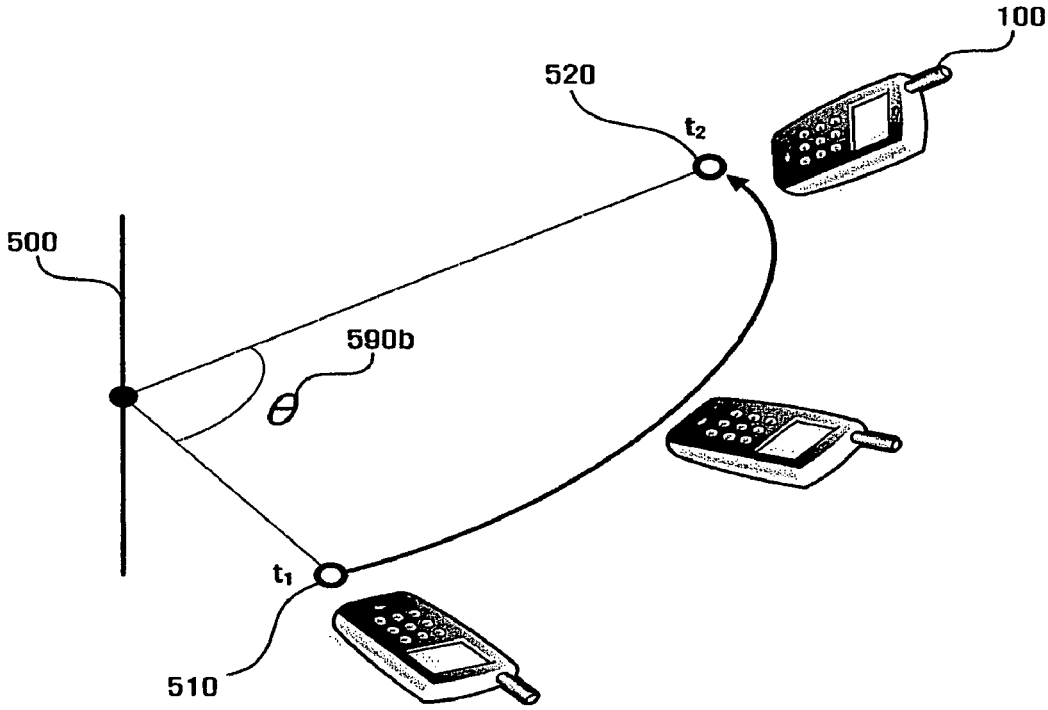
Figure 5C:
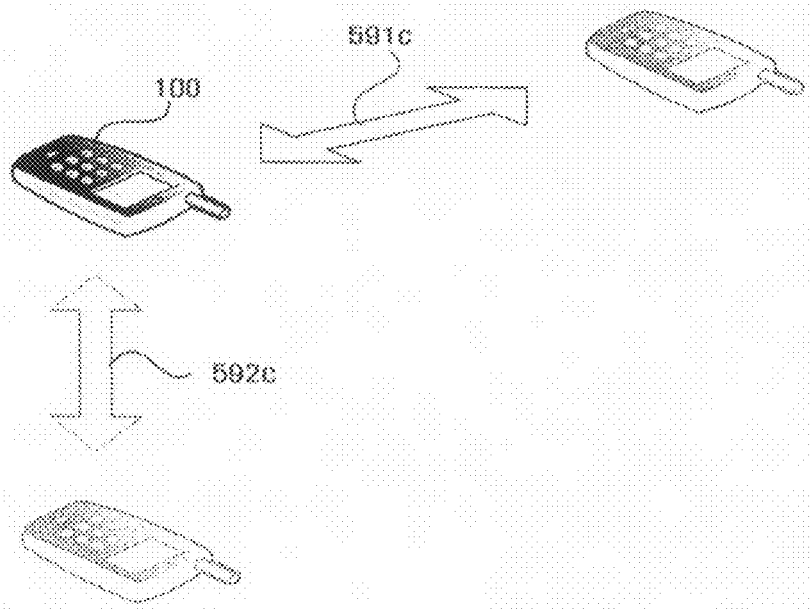

FIGS. 5A to 5C are views for explaining various methods to detect the movement direction and movement distance of the tone output apparatus according to embodiments of the present invention, in which the movement direction is detected by a gyro sensor, a geomagnetic sensor, and/or an acceleration sensor.

FIG. 5A is a view explaining a method to detect the movement direction and movement distance of the tone output apparatus 100 by means of a gyro sensor. When the tone output apparatus 100 has moved by the user, the movement corresponds to a circular movement having a central axis which extends through an elbow or shoulder of the user. Therefore, a gyro sensor detects an angular velocity 550 of the tone output apparatus 100 in relation to a center axis 500, thereby being able to detect the movement direction and distance of the tone output apparatus 100.

That is, when the tone output apparatus 100 has moved from a starting point "$t_1$" 510 to an ending point "$t_2$" 520, a movement angle "ϕ" 590*a* is determined by equation 1:

$$\phi=\int_1^2\omega_\phi(t)dt,$$

where "$\omega_\phi$" represents the angular velocity 550 of a circular movement of the tone output apparatus 100.

FIG. 5B is a view explaining a method to detect the movement direction and movement distance of the tone output apparatus 100 by means of a geomagnetic sensor. Similarly to the case shown in FIG. 5A, FIG. 5B shows the case in which the movement of the tone output apparatus 100 corresponds to a circular movement having a central axis 500 which extends through an elbow or shoulder of the user. That is, when the tone output apparatus 100 has moved from a starting point "$t_1$" 510 to an ending point "$t_2$" 520, the geomagnetic sensor calculates an angle 590*b* between the two points by comparing the direction of the starting point "$t_1$" 510 with the direction of the ending point "$t_2$" 520, thereby detecting the movement direction and distance of the tone output apparatus 100.

FIG. 5C is a view explaining a method to detect the movement distance of the tone output apparatus 100 by means of an acceleration sensor. Differently from the cases shown in FIGS. 5A and FIG. 5B, FIG. 5C shows the case in which the movement of the tone output apparatus 100 corresponds to a straight line movement. That is, the acceleration sensor detects a change 591*c* in acceleration in the horizontal direction or a change 592*c* in acceleration in the vertical direction, thereby detecting the movement distance of the tone output apparatus 100.

The tone output apparatus 100 may detect its own movement direction and movement distance by using only one of the gyro, geomagnetic, and acceleration sensors, and may detect its own movement direction and movement distance by using a combination of the sensors and a gravity sensor.

Also, as described above, the tone output apparatus 100 may detect its own movement direction and movement distance regardless of its own orientation by using a combination of multiple sensors and a gravity sensor. Therefore, although the manner in which the user holds the tone output apparatus 100 changes whenever the user moves the tone output apparatus 100, the tone output apparatus 100 can exactly identify the location of a corresponding subspace.

Figure 6:
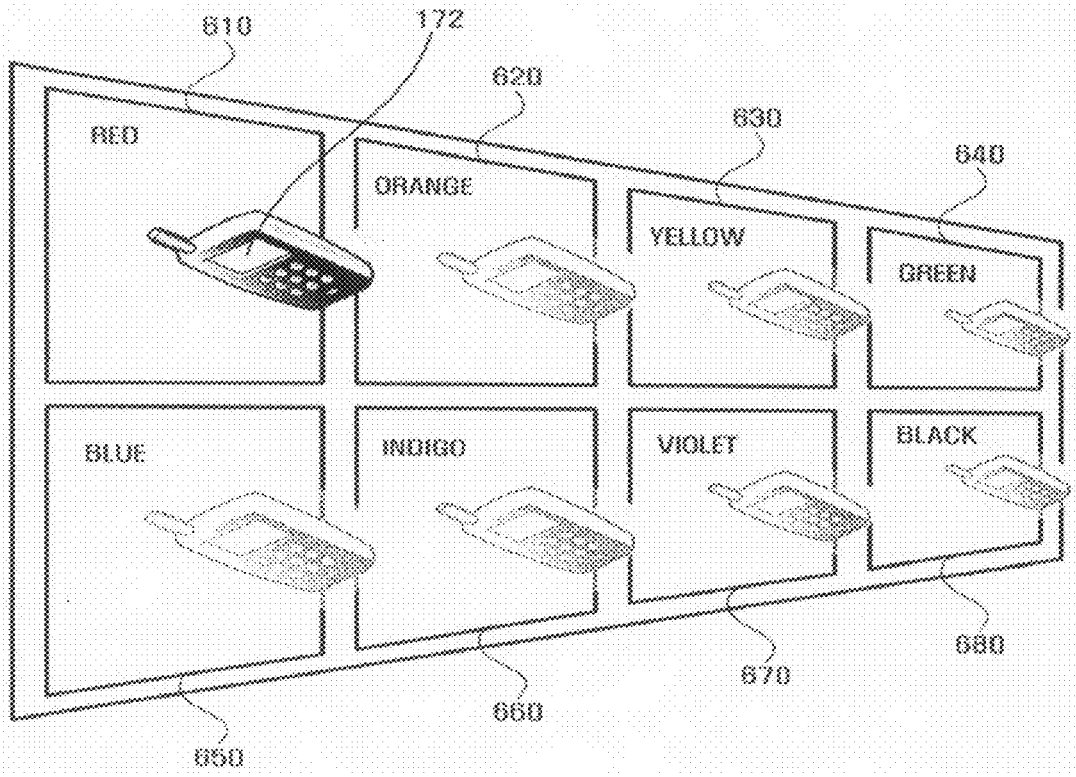
FIG. 6 is a conceptual view illustrating a tone output apparatus which displays colors corresponding to subspaces, according to an embodiment of the present invention.

FIG. 6 is a conceptual view illustrating a tone output apparatus which displays colors corresponding to subspaces, according to an embodiment of the present invention.

When the user wants to move the tone output apparatus 100 to a specific subspace, the user moves the tone output apparatus 100 in a state where it is hard to visually recognize the subspaces in the space, so that it is difficult to tell if the user is confident of movement performed by the user himself/herself. In order to solve such a problem, the display module 172 in the output unit 170 displays a color corresponding to a subspace identified by the location-identifying unit 140.

Each color corresponding to each subspace may be input by the user when the subspace table 300 has been recorded. Also, colors corresponding to the subspaces may be optionally output by the display module 172. Therefore, since the user is recognizing an approximate location of a predetermined subspace to which the user wants to move the tone output apparatus 100, the user can determine from a change of displayed color if the tone output apparatus 100 has been located in the predetermined subspace.

FIG. 6 shows the case in which red, orange, yellow, green, blue, indigo, violet, and black are set for first to eight subspaces 610 to 680, respectively. When a subspace determined by a first motion corresponds to the first motion 610, the display module 172 displays red, and when a subspace determined by a first motion corresponds to the fourth motion 640, the display module 172 displays green, respectively.

The tone output module 171 in the output unit 170 may output specified effect sounds or effect sounds corresponding to the subspaces whenever the tone output apparatus 100 moves into a different subspace. Also, the vibration module 173 may output either a vibration corresponding to each determined subspace or a vibration corresponding to each motion pattern of the second motion.

Figure 7:
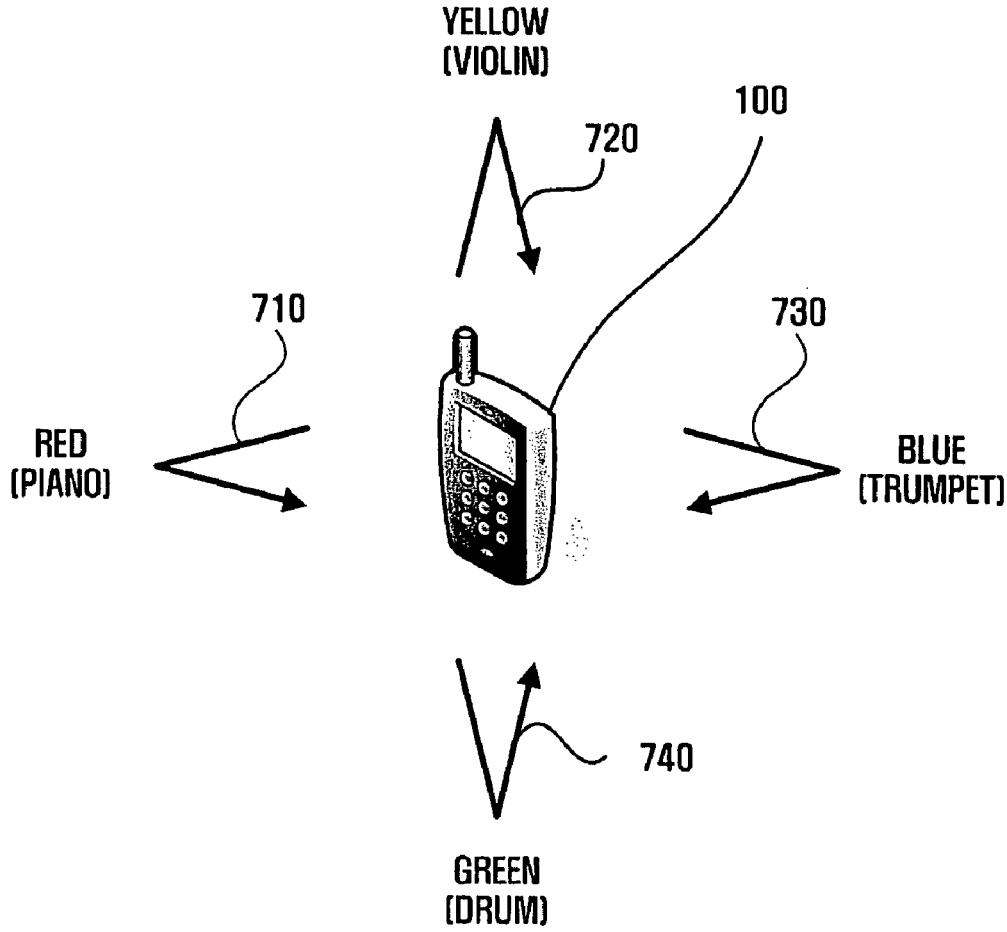
FIG. 7 is a conceptual view illustrating a tone output apparatus which displays colors corresponding to the kind of extracted musical tones, according to an embodiment of the present invention.
Figure 7:
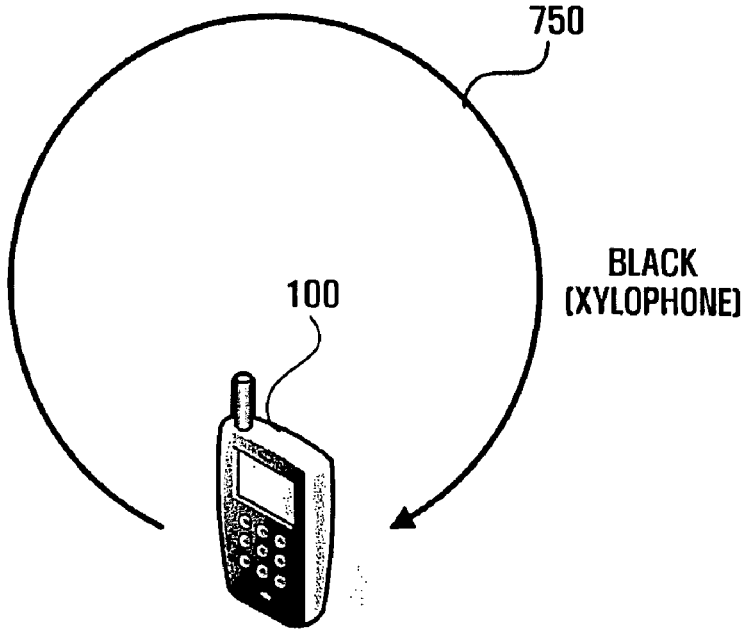

FIG. 7 is a conceptual view illustrating a tone output apparatus which displays colors corresponding to the kind of extracted musical instruments, according to an embodiment of the present invention, in which the tone output apparatus displays colors according to patterns of the second motion.

As described above, even in an equal subspace, different musical instruments can be extracted according to the patterns of the second motion. In this case, the display module 172 displays colors corresponding to the kind of the musical instruments.

As shown in FIG. 7, the patterns of the second motion may include a reciprocating motion 710 to a left-and-right direction, a reciprocating motion 720 to an up-and-down direction, a reciprocating motion 730 to a right-and-left direction, a reciprocating motion 740 to a down-and-up direction, and a circular motion 750. In this case, the tone-extracting unit 150 extracts tones of a piano, a violin, a trumpet, a drum, and a xylophone according to the motions 710 to 750, respectively, and the display module 172 displays red, yellow, blue, green, and black, respectively.

Meanwhile, when colors corresponding to the subspaces, as shown in FIG. 6, and colors corresponding to the kind of musical instruments, as shown in FIG. 7, are displayed by the display module 172 at the same time, it may confuse the user. Therefore, it is preferred that the display module 172 is constructed to separately display the two different types of color groups.

Figure 8:
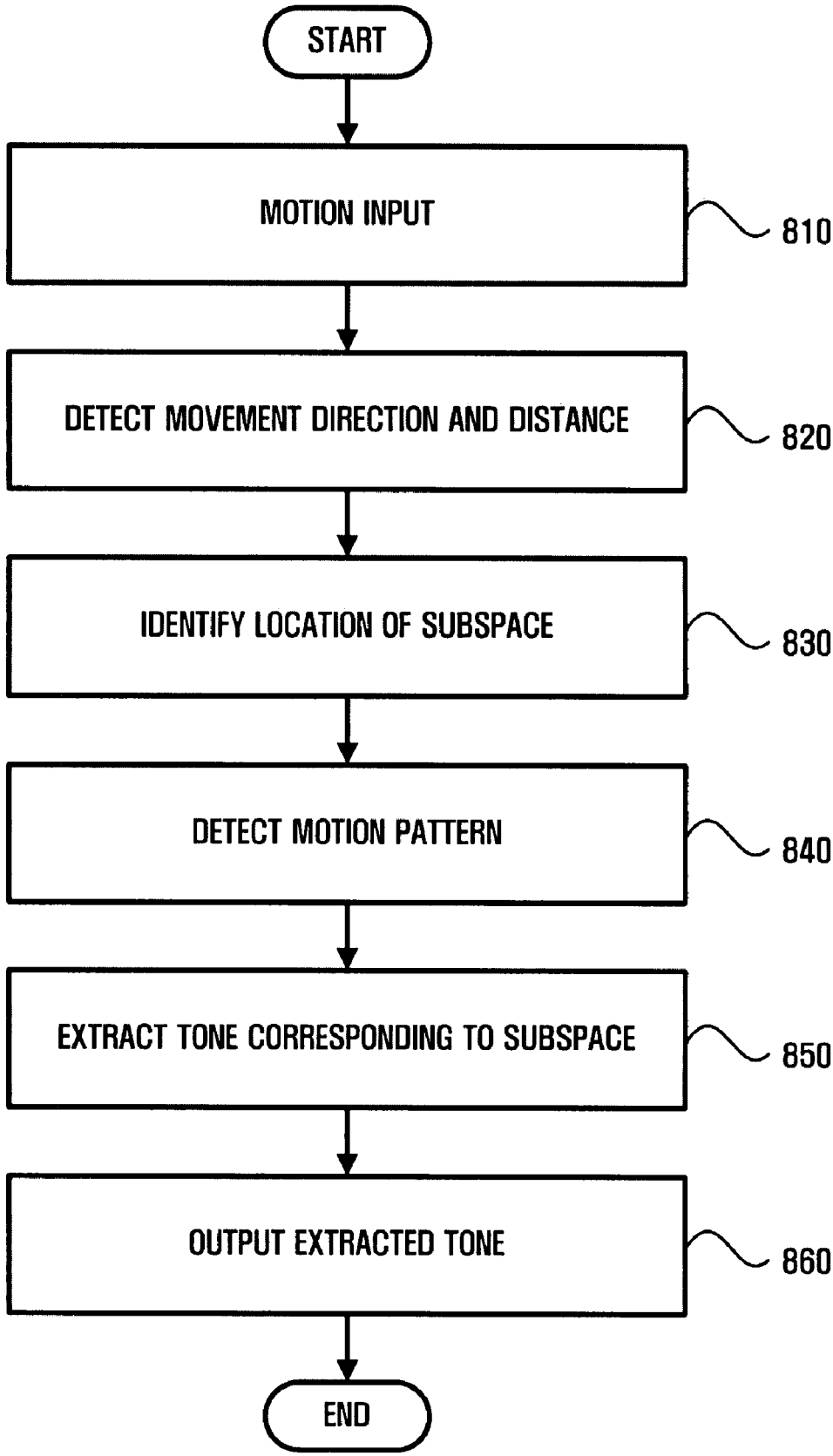
FIG. 8 is a flowchart illustrating the procedure for outputting a tone corresponding to a motion according to an embodiment of the present invention.

FIG. 8 is a flowchart illustrating the procedure for outputting a tone corresponding to a motion according to an embodiment of the present invention.

In order to output a tone according to a motion, the motion-input unit 110 of the tone output apparatus 100 first receives a motion performed by the user 810. Herein, the received motion includes a first motion for a movement and a second motion having a predetermined pattern.

In this case, the motion-input unit 110 may use at least one of the gyro, geomagnetic, and acceleration sensors in order to receive a first motion and/or a second motion performed by the user.

A motion signal generated by a first motion is transferred to the motion direction detecting unit 120, and then the motion direction detecting unit 120 detects the movement direction and movement distance of the tone output apparatus 100 by analyzing the transferred motion signal 820. In this case, the motion direction detecting unit 120 may detect the movement direction and movement distance of the tone output apparatus 100 by using a motion signal generated by one of gyro, geomagnetic, and acceleration sensors, or may detect the movement direction and movement distance of the tone output apparatus 100 by using a combination of motion signals generated by a plurality of sensors.

Also, as described above, the motion direction detecting unit 120 may detect the movement direction and movement distance of the tone output apparatus 100 regardless of the orientation of the tone output apparatus 100 by using a gravity sensor.

The movement direction and movement distance detected by the motion direction detecting unit 120 is transferred to the location-identifying unit 140, and then the location-identifying unit 140 identifies the location of a subspace determined by the first motion in a space, which has been divided into one or more subspaces, by using the detected movement direction and movement of the tone output apparatus 100, operation 830. Herein, the locations, shapes, and sizes of the subspaces, into which a space has been divided, may be determined by the user and stored in the storage unit 160.

Meanwhile, when a second motion has been input to the motion-input unit 110, a corresponding motion signal is transferred to the motion pattern detecting unit 130, and then the motion pattern detecting unit 130 detects a motion pattern of the tone output apparatus 100 by analyzing the motion signal generated by the second motion 840. The operation pattern of the tone output apparatus 100 may include not only an up/down liner movement, a left/right linear movement and a circular movement, but also a movement in a complicated geometrical figure.

An identification number of a subspace identified by the location-identifying unit 140 and a motion pattern of the second motion detected by the motion pattern detecting unit 130 are transferred to the tone-extracting unit 150. Then, the tone-extracting unit 150 extracts a tone corresponding to a subspace, which has the identification number transferred according to input of the second motion, from the storage unit 160, operation 850. That is, the tone-extracting unit 150 extracts a tone corresponding to the subspace, and in this case, the tone-extracting unit 150 may extract a tone of a musical instrument corresponding to the pattern of the second motion. Herein, each tone corresponding to each subspace may be determined and stored by the user in advance.

The extracted tone is transferred to the output unit 170, and then the output unit 170 outputs the tone 860. The output unit 170 may include not only a tone output module 171 for outputting tones, but also a display module 172 to display predetermined colors, and a vibration module 173 to generate a predetermined pattern of vibration. In this case, the display module 172 may display colors corresponding to each subspace and/or colors corresponding to each pattern of the second motion, and the vibration module 173 may generate vibrations corresponding to the first motion and/or the second motion.

As described above, the apparatus and method to output a tone corresponding to a motion according to the present invention produces the following effects.

First, a space in which the apparatus can move is divided into a plurality of subspaces, the subspaces are matched to different musical tones, respectively, and a tone corresponding to a specific subspace is then output according to a motion of the apparatus located in the specific subspace, so that the user can simply and easily select a plurality of tones to be output through the apparatus.

Secondly, since the user can perform the division into the subspaces and the set up of tone sources corresponding to each subspace, the user can easily play music according to his or her tastes.

Although preferred embodiments of the present invention has been described for illustrative purposes, those skilled in the art will appreciate that various modifications, additions and substitutions are possible, without departing from the scope and spirit of the invention as disclosed in the accompanying claims. Therefore, it should be appreciated that the embodiments described above are not limitative, but only illustrative.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus to generate a tone according to a motion of the apparatus, comprising:

a motion-input unit to detect motion of the apparatus which a first motion for movement and a second motion having a predetermined pattern are input by using at least one of a gyro-sensor and an acceleration sensor;

a location-identifying unit to identify a location of a subspace of the apparatus determined by the first motion in a space of the apparatus divided into at least one subspace;

a tone-extracting unit to extract a combined tone of a first tone corresponding to the subspace at the identified location and a second tone corresponding to the pattern of the second motion; and an output unit to output the extracted tone.

2. The apparatus of claim 1, wherein the motion-input unit separately comprises a first motion input module and a second motion input module to receive the first motion and the second motion, respectively.

3. The apparatus of claim 1, wherein locations, shapes, and sizes of the subspaces, into which the space is divided, are determined by the user or when the apparatus is manufactured.

4. The apparatus of claim 1, wherein tones corresponding to the subspaces are determined by the user or when the apparatus is manufactured.

5. The apparatus of claim 1, wherein the tone-extracting unit extracts a tone of a musical instrument corresponding to a pattern type included in the second motion.

6. The apparatus of claim 1, wherein the output unit outputs an effect sound when the determined subspace has been changed by the first motion.

7. The apparatus of claim 1, wherein the output unit displays a color corresponding to a kind of a subspace determined by the first motion.

8. The apparatus of claim 1, wherein the output unit displays a color corresponding to the extracted tone.

9. The apparatus of claim 1, wherein the output unit generates a vibration when the determined subspace has been changed by the first motion.

10. The apparatus of claim 1, wherein the output unit generates a vibration corresponding to a kind of a subspace determined by the first motion.

11. The apparatus of claim 1, wherein the output unit generates a vibration corresponding to the second motion.

12. The apparatus of claim 1, further comprises at least one of a motion direction detection unit to detect at least one of a direction of the movement and the first movement distance of the apparatus, and a motion-pattern detecting unit to detect the predetermined pattern of the second motion.

13. A method of generating a tone according to a motion of an apparatus, comprising:

receiving a first motion for movement and a second motion having a predetermined pattern from at least one of a gyro-sensor and an acceleration sensor;

identifying a location of a subspace of an apparatus determined by the first motion in a space divided into at least one subspace;

extracting a combined tone of a first tone corresponding to the subspace at the identified location and a second tone corresponding to the pattern of the second motion; and outputting the extracted tone.

14. The method of claim 13, wherein the receiving the first motion for movement and the second motion comprises:

receiving the first motion; and receiving the second motion.

15. The method of claim 13, wherein locations, shapes, and sizes of the subspaces, into which the space is divided, are determined by the user or when the apparatus is manufactured.

16. The method of claim 13, wherein tones corresponding to the subspaces are determined by the user or when the apparatus is manufactured.

17. The method of claim 13, wherein, the extracted tone includes a tone of a musical instrument corresponding to a pattern type included in the second motion.

18. The method of claim 13, wherein, the output tone includes a sound effect output when the determined subspace has been changed by the first motion.

19. The method of claim 13, wherein, a color corresponding to a kind of the subspace determined by the first motion is displayed together with the output tone.

20. The method of claim 13, wherein, a color corresponding to the extracted tone is displayed together with the output tone.

21. The method of claim 13, wherein, a vibration is generated when the determined subspace has been changed by the first motion, together with the output tone.

22. The method of claim 13, wherein, a vibration corresponding to a kind of a subspace determined by the first motion is generated together with the output tone.

23. The method of claim 13, wherein, a vibration corresponding to the second motion is generated together with the output tone.

24. The method of claim 13, further comprises at least one of detecting at least one of a direction of the movement and the first movement distance, and detecting the predetermined pattern of the second motion.

25. An apparatus for generating a tone according to a motion, comprising:

a motion-input unit to detect motion which a first motion for movement and a second motion having a predetermined pattern are input by using at least one of a gyro-sensor and an acceleration sensor;

a motion direction detection unit to detect at least one of movement direction and the first movement distance of the apparatus;

a motion-pattern detecting unit to detect the second motion of the apparatus;

a location-identifying unit to identify a location of a subspace determined by the first motion in a space divided into at least one subspace;

a tone-extracting unit to extract a combined tone of a first tone corresponding to the subspace at the identified location and a second tone corresponding to the pattern of the second motion; and an output unit to output the extracted tone.

26. The apparatus of claim 25, further comprises a storage unit to store a tone.

27. The apparatus of claim 25, further comprises at least one of a display module to display a color on the apparatus and a vibration module to vibrate the apparatus.

* * * * *